US005353526A

United States Patent [19]

Foley et al.

[11] Patent Number: 5,353,526

[45] Date of Patent: Oct. 11, 1994

[54] MIDSOLE STABILIZER FOR THE HEEL

[75] Inventors: Peter M. Foley, Needham; Steven F. Smith, Taunton, both of Mass.

[73] Assignee: Reebok International Ltd., Stoughton, Mass.

[21] Appl. No.: 189,288

[22] Filed: Jan. 31, 1994

Related U.S. Application Data

[63] Continuation of Ser. No. 65,064, May 24, 1993, abandoned, which is a continuation of Ser. No. 741,336, Aug. 7, 1991, abandoned.

[51] Int. Cl.[5] ..... A43B 7/16

[52] U.S. Cl. ..... 36/92; 36/35 R

[58] Field of Search ..... 36/91, 28, 30 R, 3 B, 36/35 R, 31, 68, 69, 169, 172, 92, 148, 162, 27

[56] References Cited

U.S. PATENT DOCUMENTS

| | | | |
|---|---|---|---|
| 4,322,892 | 4/1982 | Inohara | 36/29 |
| 4,854,055 | 8/1989 | Sugiyama et al. . | |
| 5,025,573 | 6/1991 | Giese et al. . | |
| 5,155,927 | 10/1992 | Bates et al. | 36/28 |
| 5,224,277 | 7/1993 | Sang Do . | |

FOREIGN PATENT DOCUMENTS

| | | |
|---|---|---|
| 16272 | 3/1881 | Fed. Rep. of Germany . |
| 1239033 | 10/1959 | France . |
| 2208279 | 6/1974 | France . |
| 91-1211 | 2/1991 | Rep. of Korea . |

OTHER PUBLICATIONS

*Runner's World,* "Ventilator" advertisement, Aug. 1990.

*Primary Examiner*—Paul T. Sewell
*Assistant Examiner*—Thomas P. Hilliard
*Attorney, Agent, or Firm*—Sterne, Kessler, Goldstein & Fox

[57] ABSTRACT

A heel stabilizer is provided for the midsole of a shock absorbing sole in footwear. The stabilizer may be provided on a side of a shoe or may surround the entire heel area of the shoe. A stabilizer which surrounds the heel area may be formed as a single piece which wraps around the heel area or may be formed of several pieces joined to form a frame. The stabilizer includes cells when viewed in vertical cross section which provide lightweight, stable cushioning to the foot along the periphery of the midsole. The cells may take a variety of geometric configurations.

7 Claims, 9 Drawing Sheets

MIDSOLE STABILIZER FOR THE HEEL

This application is a continuation, of application Ser. No. 08/065,064, filed May 24, 1993, now abandoned is a continuation of application Ser. No. 07/741,336 filed Aug. 7, 1991, now abandoned.

FIELD OF THE INVENTION

The present invention relates to a lightweight, mechanical (i.e. non-foam) stabilizer for the midsole of a shoe and more particularly to a stabilizer for the heel portion of an athletic shoe sole.

BACKGROUND OF THE INVENTION

Since the beginning of time man has sought ways to provide a shoe sole that is stable, yet comfortable. Typically, the stability of a shoe sole is enhanced by increasing its rigidity. Comfort is typically enhanced by increasing the cushioning provided in the shoe. Thus, the more stable the shoe the less cushioning that is provided, and conversely, the more cushion that is provided the less stable the shoe. As a result, stability is often sacrificed for the sake of comfort, and vice versa.

In this century, the introduction of shoes designed specifically for athletic purposes has highlighted this problem. Many athletic activities involve running and jumping that translate to high impact forces on the foot. As a result, today's typical athletic shoe sole includes a cushion "midsole" layer that is sandwiched between the insole and outsole layers of the sole. This midsole layer is usually made of a foam material to provide the maximum cushion effect to the foot. Unfortunately, the effect is much the same as providing an ordinary "kitchen sponge" in a pair of dress shoes, that is, only minimal impact absorption is provided. Moreover, the foam cushion material does little to stabilize the foot within the shoe. In particular, the foam cushion has no stability along the edge of the midsole, an area which without support can cause the foot to roll over upon impact with the ground (pronation and supination). Such rollover is a major cause of injury during athletic activity.

On the other hand, a midsole that does not provide adequate cushion to the foot and does not absorb impact can itself cause injury to the foot. Therefore, a balance between comfort and stability is essential in any performance athletic shoe.

Various attempts have been made to "stabilize" foam midsoles. One example is shown in U.S. Pat. No. 4,506,462 to Cavanaugh which utilizes different density foam in select areas of the midsole. One problem associated with this type of stabilizer is that the harder density foam is often so hard that it does not compress at all under the forces encountered during typical athletic activity. Other attempts, such as U.S. Pat. No. 4,402,146 to Parracho et al. have provided a tab made of a material harder than the midsole adjacent the heel to prevent heel "rollover." A problem with this type of stabilizer is that the tab is often a heavy, solid plastic device that is so hard and unyielding that it can itself cause injury to the foot if the foot contacts the ground improperly, for example. Some, such as U.S. Pat. No. 4,297,796 to Stirtz et al. bond a mesh web to the exterior of a conventional cushion layer midsole to distribute shock along the sole of a shoe. Others, such as U.S. Pat. No. 4,535,553 to Derderian et al. and U.S. Pat. No. 4,774,774 to Allen, Jr. encase a shock absorbing insert within a conventional cushion midsole of a shoe. Thus, the need exists for a stabilizer for the midsole of a shoe which provides optimum peripheral rigidity while maintaining a central cushioning core.

SUMMARY OF THE INVENTION

The present invention may be characterized as an article of footwear comprising a foot support-for supporting a portion of the foot of the wearer and a stabilizer adjacent an exterior sidewall of the foot support. The stabilizer includes a top surface for supporting the foot of the wearer, a bottom surface spanning substantially the entire length of the stabilizer, and has a side surface which includes a plurality of cells when viewed in vertical cross section for providing controlled cushioning to the foot of the wearer. The first foot support may include a heel end and the stabilizer may surround the heel end of the foot support. The stabilizer may be U-shaped and the cells may be six sided. Furthermore, the cells may be formed of at least five obtuse angles. The stabilizer may be formed of a plurality of individual elements including a medial or arch piece which is harder than a portion of the remainder of the stabilizer. The remainder of the stabilizer may include a lateral piece and a heel piece of substantially the same hardness. The remainder of said stabilizer may also include a lateral arch piece. The foot support may be formed of a cushion material, which in turn may include a fluid-filled bladder. An outsole and an upper may be attached to the foot support. The foot support may extend from a toe portion of the article of footwear to a heel portion thereof. The cells may extend completely through the stabilizer.

In addition, the present invention may be characterized as an article of footwear comprising a foot support formed of cushion material and including a toe end and a heel end. A substantially U-shaped heel stabilizer may surround the heel end of the foot support. The heel stabilizer may include a plurality of six sided cells when viewed in vertical cross section. Each of the cells may be formed of at least five obtuse angles. The heel stabilizer may further include a plurality of individual elements including a lateral piece, an arch piece and a heel piece joined together to form the heel stabilizer. The arch piece may be made of a material that is harder than the material from which the lateral piece and the heel piece are made.

The foregoing and other objects, features and advantages of the invention will be apparent from the following more particular description of the preferred embodiments of the invention, as illustrated in the accompanying drawings.

DETAILED DESCRIPTION OF THE PREFERRED EMBODIMENTS

Figure 1:
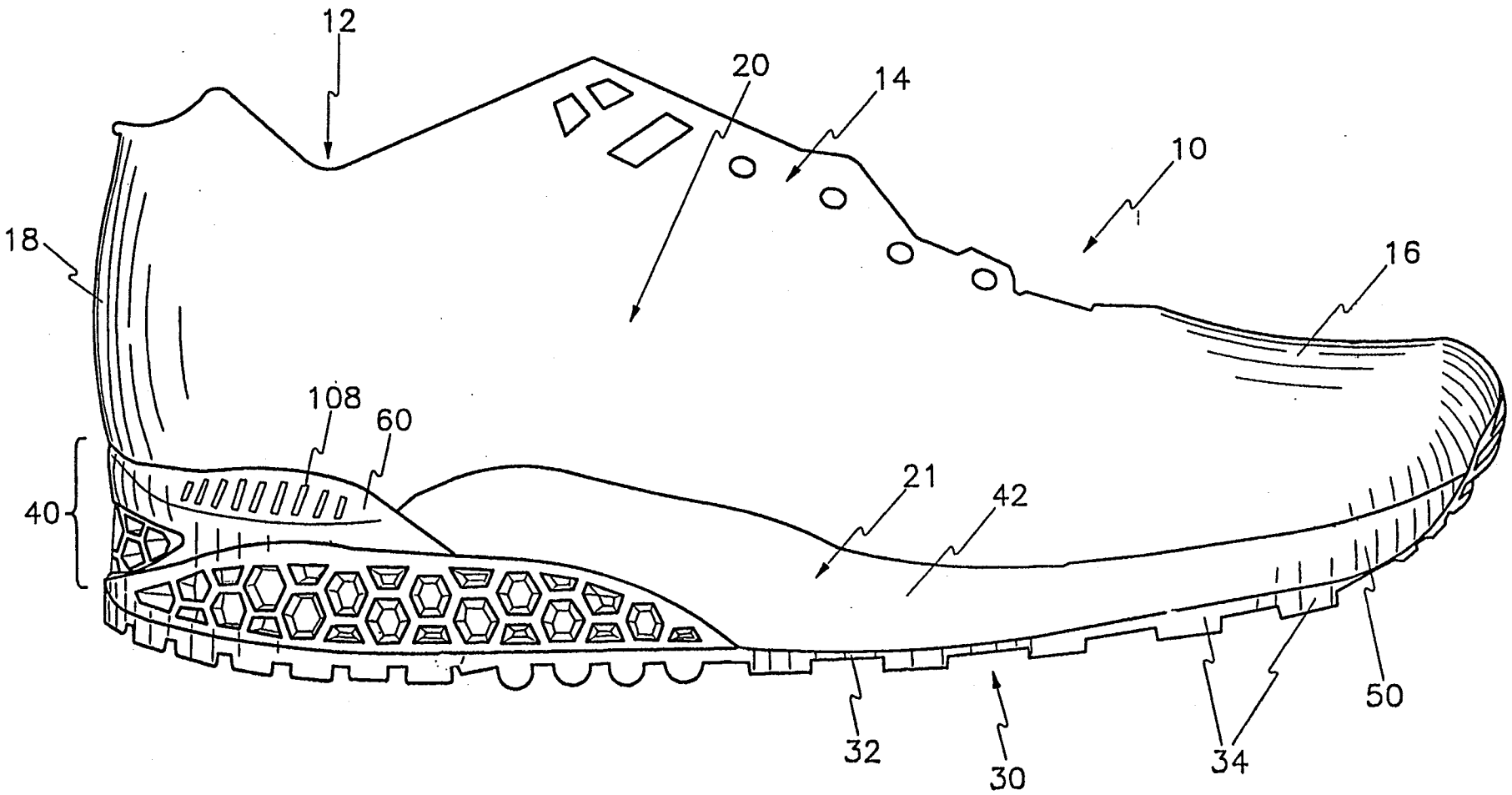
FIG. 1 is a left side elevational view of a shoe for the right foot including a midsole frame of the present invention.

The present invention provides a lightweight midsole that both cushions the foot as well as provides stability along the edge of the sole to prevent rollover. By encasing the rear portion of a cushion midsole in a more rigid frame, the edge stability of the midsole is increased, while the inner cushioning of the midsole is maintained. Furthermore, the present invention provides a frame that too is compressible and that may be "tuned" to the individual needs of the wearer by varying the placement, configuration and material used to form the frame.

Turning now to the Figures in which similar reference numerals have been used to designate similar features of the invention, an athletic shoe for the right foot incorporating the present invention is shown. An athletic shoe for the left foot would be a mirror image of that shown. Although what would typically be considered a "running shoe" is shown in the drawings, the present invention is equally suited for incorporation into other types of athletic footwear including shoes for walking and for court sports such as basketball, tennis and volleyball. The shoe of FIG. 1 includes an upper 10 which is attached to a sole 30. The upper 10 can be made of any suitable material such as canvas or leather. As with conventional uppers, the upper 10 includes a foot opening 12 in which the foot of a wearer is received. An eyestay 14 is provided for receiving shoe laces or other fastening means for securing upper 10 about the foot of the wearer.

Upper 10 includes a forefoot portion 16 and a midfoot portion 20 which is situated between forefoot portion 16 and rearfoot portion 18. Sole 30 includes an outsole 32 and a midsole 40. Outsole 32 is preferably made of rubber or urethane, although other suitable durable materials may be used. Outsole 32 includes treads 34 which provide traction to outsole 32. Treads 34 may be made of the same material or a different material from that which outsole 32 is made. Outsole 32 extends from forefoot portion 16 to rearfoot portion 18 of upper 10 and may be a single piece of material as shown, or several individual pieces. Outsole 32 is attached to midsole 40 by any suitable means such as an adhesive. Similarly, midsole 40 is attached to upper 10 by any suitable means including adhesive. The article of footwear may also include an insole and sock liner, as is conventional in the art.

Midsole 40 includes a foot support 42 and a stabilizer 60. Foot support 42 is formed of any suitable lightweight cushion material, and preferably is formed of a foam selected from the group consisting of polyurethane (PU), ethylvinyl acetate (EVA) and HYTREL® (a semi-crystalline, fully polymerized, high molecular weight elastomer composed of alternate amorphous and crystalline chains available from E. I. DuPont deNemours Company, Inc., Wilmington, Del.). Foot support 42 extends approximately from forefoot or toe portion 16 to rearfoot or heel portion 18 of upper 10 and generally follows the profile of a human foot. The thickness of foot support 42 varies along its length from approximately ½ inch under the ball of the foot 17 to one inch in the arch or midfoot portion 21 of the shoe. Foot support 42 includes a foot supporting surface 44 (see FIG. 2, shown in phantom) upon which the foot of a wearer is supported.

Foot supporting surface 44 includes a toe end 46 and a heel end 48. Toe end 46 and heel end 48 underlie the toe and heel areas of the foot of a wearer, respectively. A sidewall 50 extends along the periphery of foot support 42. Sidewall 50 is preferably slightly slanted such that the surface area of the bottom of foot support 42 is greater than the surface area of foot supporting surface 44. Sidewall 50 includes a notch 52 along the lateral side of the shoe, and a similar notch 54 along the medial side. Stabilizer 60, which is described in greater detail below, includes complimentary protrusions or steps which are received within the notches 52 and 54 when the midsole 40 is assembled.

Figure 2:
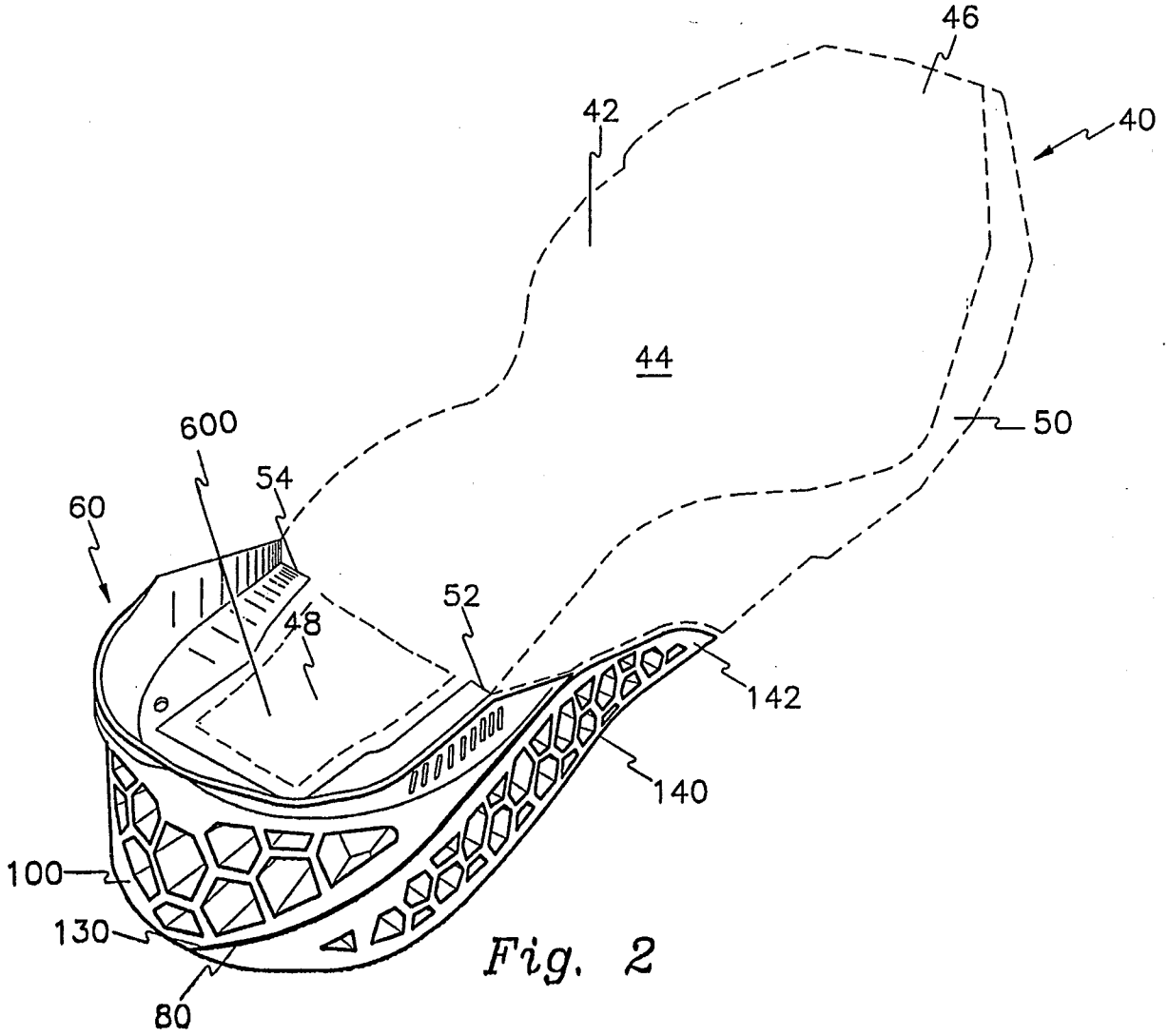
FIG. 2 is a right perspective view of a portion of the midsole frame of the present invention for a shoe for the right foot.

With continuing reference to FIG. 2, stabilizer 60 surrounds heel end 48 of foot support 42 and is preferably made of three individual pieces which are joined to form a U-shaped frame. These individual pieces include an arch piece 70 (FIG. 3), a heel piece 100 and a lateral piece 140, each of which will be described in detail below. Stabilizer 60 is flexible enough to absorb impact as the shoe contacts the ground. Stabilizer 60 may be made of any suitable material and preferably is made of elastomeric plastic. One such suitable plastic is PELLETHANE TM a thermoplastic urethane (TPU) material available from Dow Chemical Corporation, Midland, MI. The preferred material is available under the designation #2102. PELLETHANE TM 2102 is a polyester Polycaprolactone which is elastomeric, resilient, lightweight, chemical resistant, bonds to suitable midsole foams, outsole and upper materials. Another suitable material is HYTREL® which has similar characteristics. Arch piece 70, heel piece 100 and lateral piece 140 may have the same hardness or their hardnesses may be different. In the preferred embodiment, arch piece 70 is made from a resin having a shore A hardness of 75. Heel piece 100 and lateral piece 140 are made from a resin having a shore A hardness of 85. The pieces are preferably injection molded to form the desired shapes. However, any known technique may be used. After molding, the pieces are joined by adhesive, for example.

Figure 3:
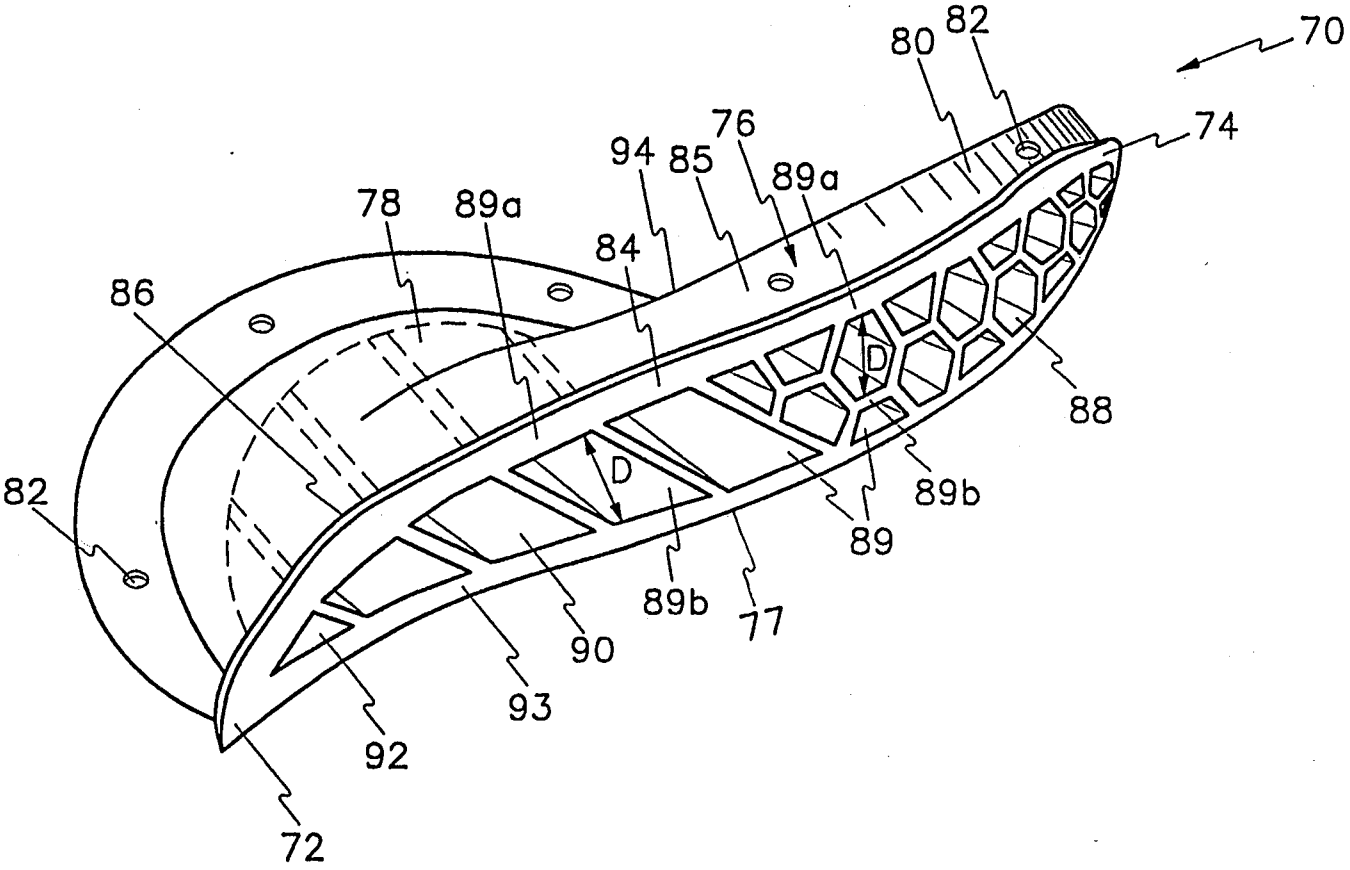
FIG. 3 is a right perspective view of the arch piece of the midsole frame of FIG. 2.

Arch piece 70, which is best seen in FIG. 3 includes a front terminus 72 and a heel terminus 74 between which is provided a foot supporting surface 76 and an opposing bottom or base surface 77. Foot supporting surface 76 includes an arch support 78 and a top support 80. Arch supporting surface 78 is semi-circular in shape and unitary with top support 80. An exterior sidewall 84 extends in a curve between front terminus 72 and heel terminus 74. That is, sidewall 84 curves inwardly at 93 as it approaches front terminus 72 from heel terminus 74. Curve 93 corresponds with the natural curve of the foot at the longitudinal arch of a typical foot. A lip 86 extends upwardly from top support 80 of foot supporting surface 76. Exterior sidewall 84 tapers along its length from a central portion 85 that is preferably approximately ¾ inch in height (excluding lip 86) toward front terminus 72 and heel terminus 74. Lip 86 is preferably 1/16 inch in height. Lip 86 assists in the mating of arch piece 70 with heel piece 100 as described below and hides the bond line where the two pieces are joined.

Formed along exterior sidewall 84 of arch piece 70 is a lattice of cells 89 which not only reduce the weight of the midsole, but also provide controlled cushioning to the foot of the wearer. That is, as the weight of the wearer is applied to top surface 80, cells 89 compress, such that the distance D between top wall 89*a* and bottom wall 89*b* of each cell is decreased. This compression absorbs impact to the foot which would otherwise be absorbed by the foot. Three geometric configurations of cells 89 are shown in FIG. 3, they are hexagonal-shaped cells 88, quadrilateral-shaped cells 90 and triangular-shaped cells 92. Hexagonal-shaped cells 88 are six sided and may be formed of at least five obtuse angles. Quadrilateral-shaped cells 90 may be any four sided geometric structure; triangular-shaped cells may be any three sided geometric structure. Cells 89 can be in any geometric shape, such as circles, semi-circles, ovals and arcs. The angles between walls forming the cells may be varied in order to achieve optimum rigidity and cushioning for the desired use of the shoe. For example, the slanted vertical walls forming the quadrilateral-shaped cells 90 in the forepart of lateral piece 70 are slanted toward forward terminus 72 at approximately a 45° angle.

Cells 89 may extend completely through arch piece 70 from exterior wall 84 to an interior wall 94. However, it is not essential that they do so. That is, a thin layer of material could remain along either or both walls, such that cellular shaped recesses or chambers are formed rather than complete apertures. In its preferred embodiment, the width of exterior side wall 84 between cells 89 is approximately $\frac{3}{8}$ inch. However, the width of interior wall 94 between cells 89 is approximately $\frac{1}{4}$ inch. By thickening the interior wall 94, it has been found that the pieces can be more efficiently molded and provide increased stability to the foot and compress, that is, cushion, more when the edge of the stabilizer first strikes the ground. As the foot rolls inward the thicker cell walls resist compression more helping to stabilize the foot. If desired, the piece could be molded so that the thicker walls are on the exterior of the piece (wall 84) rather than on the interior (wall 94). Apertures 82 may be provided anywhere along the surface of arch support 78 and top support 80 to reduce the weight of arch piece 70. These apertures aid removal from the mold during manufacture. Furthermore, rather than complete apertures 82, recesses could be provided.

Figure 4:
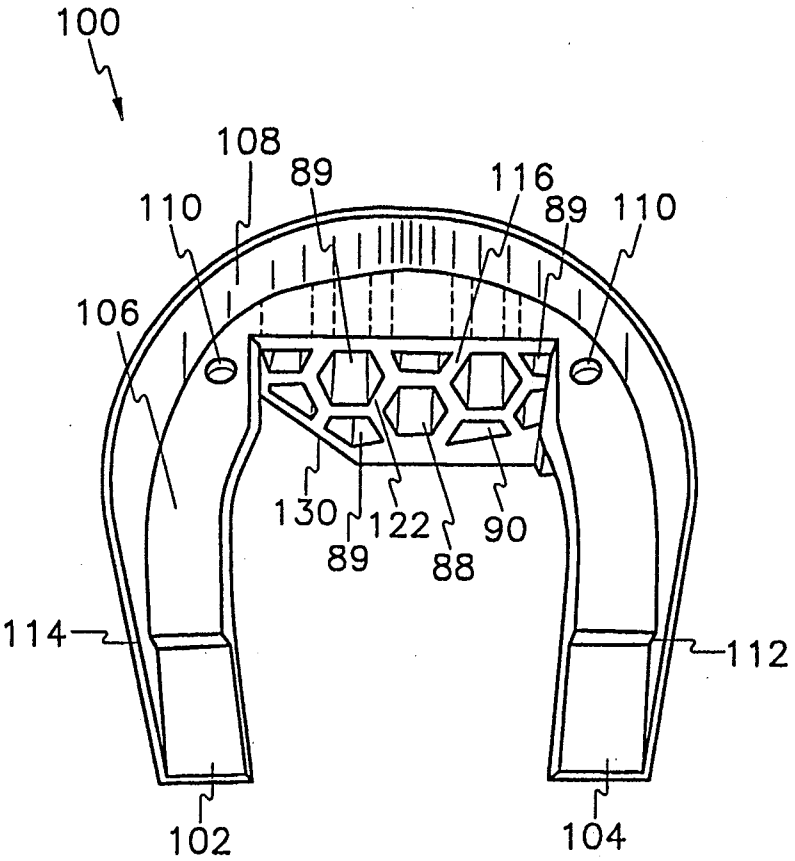
FIG. 4 is a front perspective view of the heel piece of the midsole frame of FIG. 2.
Figure 5:
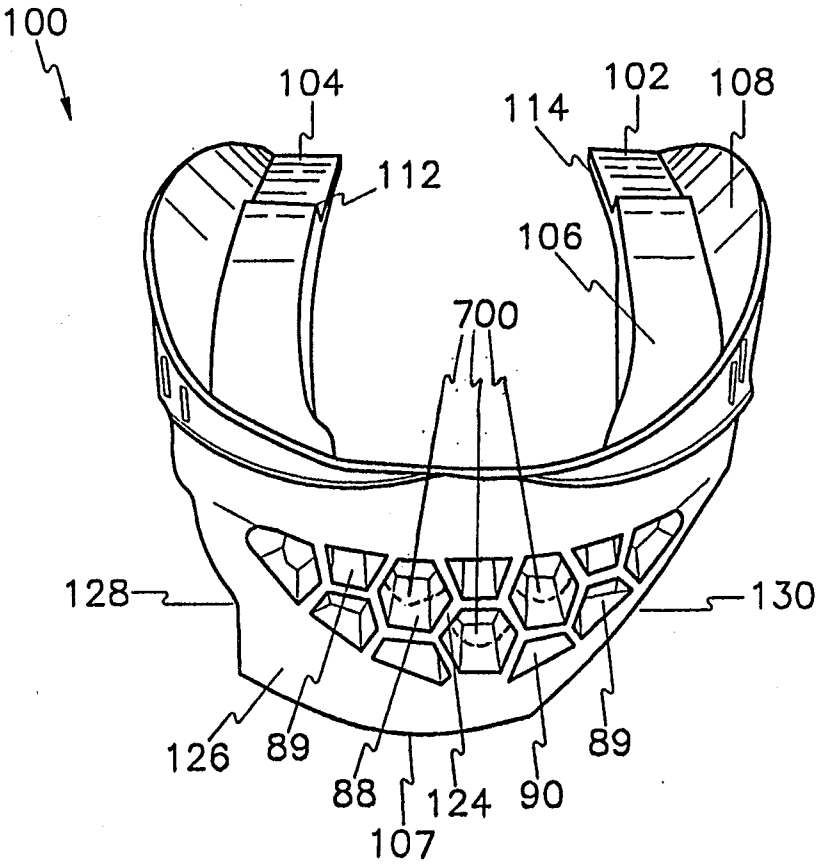
FIG. 5 is a rear perspective view of the heel piece of FIG. 4.

Turning now to FIGS. 4 and 5 in which heel piece 100 is shown, heel piece 100 is generally U-shaped or horse shoe shaped, extending from a lateral end 102 to a medial end 104. Heel piece 100 includes a foot supporting surface 106, an opposing bottom or base surface 107, an interior sidewall 122 and an exterior sidewall 124. Foot supporting surface 106 is flush with foot supporting surface 44 of foot support 42 (FIG. 2), and includes an exterior, upwardly extending flange 108 which overlies rearfoot portion 18 of upper 10 (FIG. 1). Medial end 104 includes a medial step 112 which assists in positioning foot support 42 within heel piece 100. That is, notch 52 of foot support 42 is received in step 112. Similarly, a lateral step 114 is provided on lateral end 102 of heel piece 100 to receive notch 54 of foot support 42.

A lattice of dells 89, similar in construction to those formed in arch piece 70 are provided in heel piece 100. A plurality of cells 89 extend completely through the piece from interior wall 122 to exterior wall 124. As with arch piece 70 described above, although hexagonal-shaped cells 88 and quadrilateral-shaped cells 90 are shown, any geometric configuration may be substituted therefor. Furthermore, as with arch piece 70, interior wall 122 between cells 89 are wider than corresponding exterior wall 124. Similarly, the placement and configuration of cells 89 can vary according to the specific needs of the wearer.

With specific reference to FIG. 5, a solid medial heel extension 126 is provided along the medial side of heel piece 100. Medial heel extension 126 provides added stability to the medial rearfoot portion of the foot particularly against inward rollover (pronation). In the alternative, a similar heel extension could be provided along the lateral rear portion of heel piece 100 to prevent outward rollover (supination). As best seen in FIG. 1, lateral side surface 130 of heel piece 100 joins with top surface 180 of arch piece 70. As described below, medial side surface 128 joins with the top surface of lateral piece 140. Weight reducing apertures and/or recesses 110 may be formed in surface 106. Although only two such recesses are shown, more may be provided so long as they will not interfere with the structural integrity of the piece either in use or during molding.

Figure 6:
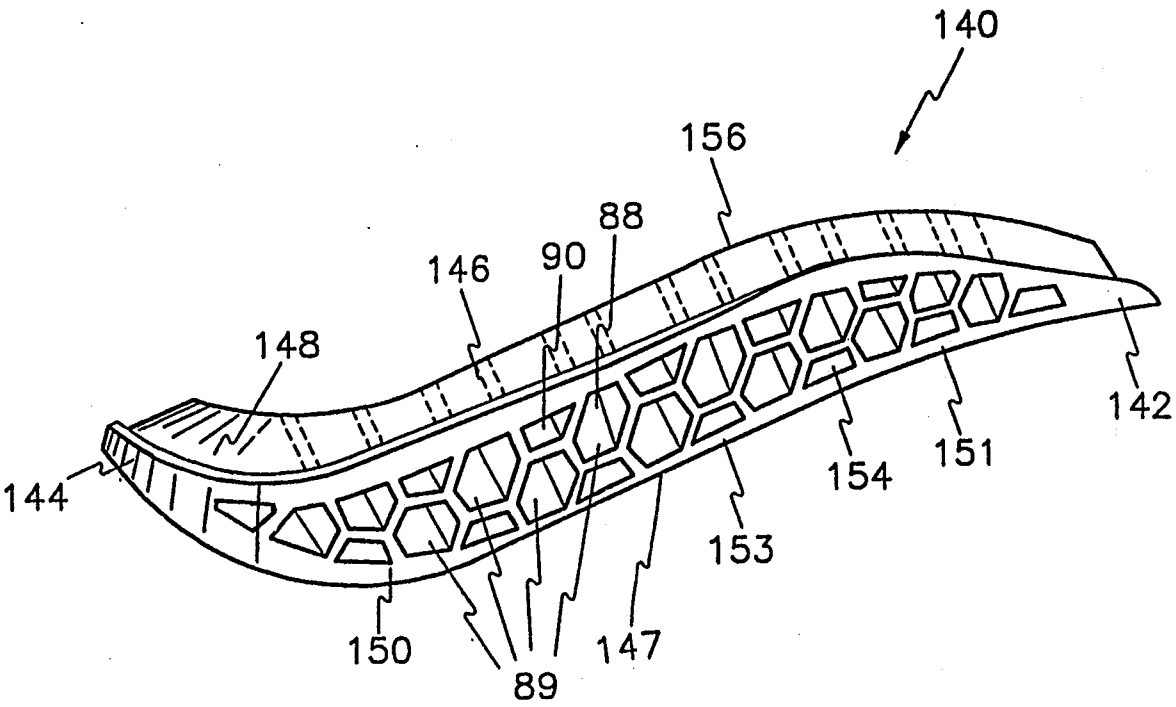
FIG. 6 is a left perspective view of the lateral piece of the midsole frame of FIG. 2.

With reference to FIG. 6, lateral piece 140 is shown. Lateral piece 140 includes a top or foot supporting surface 146 and an opposing base or bottom surface 147 which extends between a front terminus 142 and a heel terminus 144. As best seen in FIG. 2, front terminus 142 extends forward along sole 30 to beyond the typical impact zone of the foot (i.e., the part of the sole which touches the ground upon heel strike). Weight reducing apertures or recesses (not shown) may be formed in top surface 146. A lip 148, similar to lip 86 of arch piece 70 extends upwardly approximately 1/16 inch from top surface 146 to assist in the joining of lateral piece 140 with heel piece 100. Lateral piece 140 tapers from a center portion 153 to front terminus 142 and heel terminus 144. The preferred maximum height of lateral piece 140 is approximately $\frac{3}{4}$ inch, excluding lip 148. As mentioned above, top surface 146 joins medial side surface 128 of heel piece 100 when the pieces are joined to form frame 60. An exterior sidewall 150 is provided along the length of lateral piece 140. Sidewall 150 curves outwardly as at 151 to follow the profile of the human foot.

Similar to arch piece 70 and heel piece 100, a lattice of cells 89 are provided in exterior wall 150. As with the above-described cells 89, although only hexagonal-shaped cells 88 and quadrilateral-shaped cells 90 are shown, the cells may take a variety of geometric configurations and may extend from exterior surface 150 through to an interior surface 156 of piece 140. Furthermore, the thickness of the walls between the cells 89 on exterior surface 150 is less than the thickness of the walls between cells 89 along interior surface 156, as described above. When individual pieces or elements 70, 100 and 140 are joined to form stabilizer 60, as shown in FIGS. 1 and 2, their combined bottom surfaces span substantially the entire length of the stabilizer to form a load-bearing surface for the weight of the wearer. Furthermore, their combined top surfaces support the bottom of the foot of a wearer.

Figure 7:
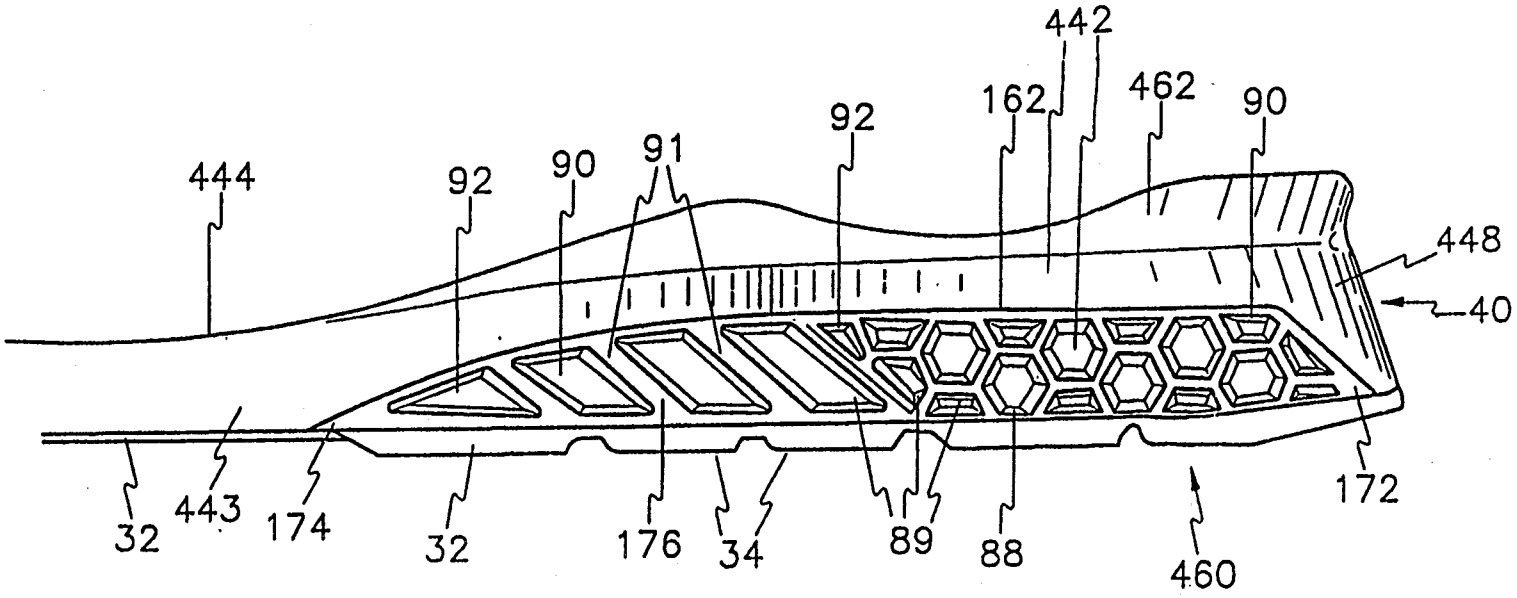
FIG. 7 is a side view of a modification of the midsole frame of the present invention with an arch piece only.

Turning now to FIG. 7, a modified embodiment of the present invention is shown in which the stabilizer extends along only one side (either the medial or lateral side) of the shoe. As in FIGS. 1–6, FIG. 7 shows a portion of a sole including a midsole 40 and an outsole 32. Outsole 32 includes traction treads 34. Midsole 40 includes a foot support 442 and a stabilizer 460. Foot support 442 is similar in construction to foot support 42 described above and includes a foot supporting surface 444 upon which the foot of a wearer is supported. Heel area 448 of foot support 442 includes a flange 462 which extends upwardly from foot supporting surface 444 and overlies the upper of the shoe (not shown). A recess 162 is formed within foot support 442 along the lateral side thereof. Stabilizer 460 is received within recess 162 between the heel area 448 and outsole 32 and surrounds a portion of foot support 442. Stabilizer 460 preferably extends longitudinally from the heel area 448 to the midfoot or medial arch area 443 of midsole 40. Stabilizer 460 preferably extends transversely approximately one-third of the way toward the medial side of the shoe. Stabilizer 460 includes a heel terminus 172 and a forward terminus 174 with an exterior side surface 176 extending therebetween. Forward terminus 174 extends toward the toe end of the midsole beyond the typical area of foot impact upon heel strike and therefore, terminates approximately equal to the front terminus 72 of arch piece 70 described above. Stabilizer 460 is molded of any plastic material and preferably of PELLETHANE® as described above.

A lattice of cells 89 are formed in side surface 176. As in the previously described embodiments, cells 89 are hexagonal-shaped 88, quadrilateral-shaped 90 and triangular-shaped 92. As shown, the thickness of the walls between cells 89 in the rear part of stabilizer 460 may be less thick than the walls formed between cells 89 in the forepart of the stabilizer. This provides a stabilizer with a more flexible rear part compared to the forepart to absorb shock to the wearer's heel. As with the previous embodiments, it is not necessary that the cells extend completely through insert 170. Furthermore, as previously described, the walls between cells 89 on the exposed surface 176 may be thinner than corresponding walls between cells 89 on the interior surface of stabilizer 460. Although slanted pillars 91 are shown only in the forepart of stabilizer 460, under the arch, it is possible that such pillars could extend along the entire length of the stabilizer.

Figure 8:
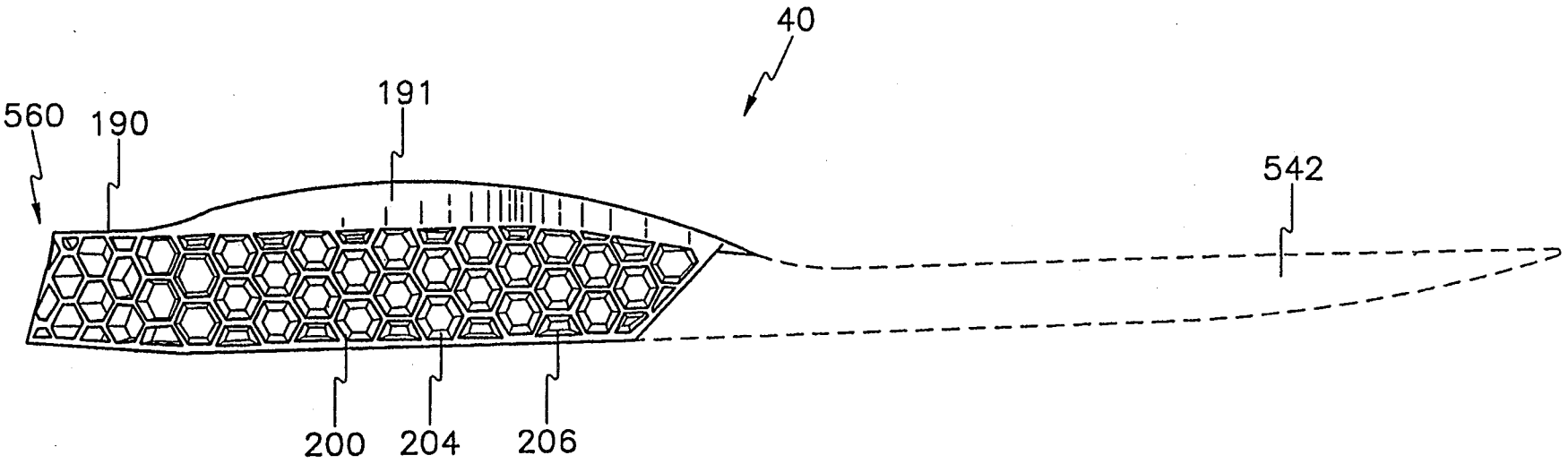
FIG. 8 is a side view of a further modification of the midsole frame of the present invention.
Figure 9:
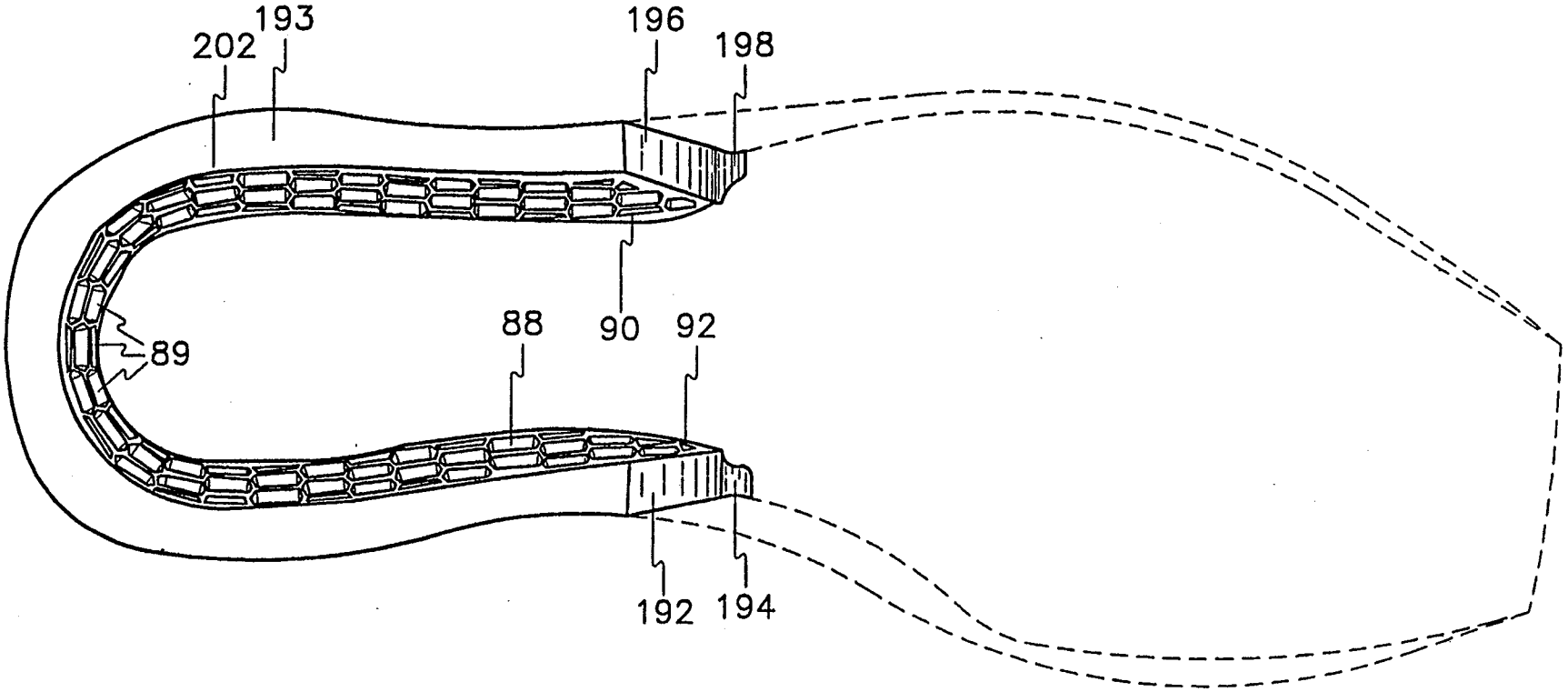
FIG. 9 is a bottom plan view of the midsole frame of FIG. 8.

A further modified embodiment of the invention is shown in FIGS. 8 and 9 of the drawings. This embodiment also includes a stabilizer and a foot support similar to those elements described above. However, in this embodiment, stabilizer 560 is a unitary frame which surrounds the entire rearfoot portion of the foot support 542 (shown in phantom). Stabilizer 560 is molded in a curved configuration or horse shoe shape of any plastic material and preferably of PELLETHANE® as described above. Stabilizer 560 includes a foot supporting surface 190, and a flange 191 which extends upwardly from foot supporting surface 190 to overlie the shoe upper (not shown). Foot supporting surface 190 extends from medial end 192 to a lateral end 196 of stabilizer 560. A medial tab 194 is provided at medial end 192 for bonding stabilizer 560 to foot support 542. Similarly, lateral end 196 includes a lateral tab 198 for bonding to foot support 542. An exterior sidewall. 200 surrounds the entire exterior surface of stabilizer 560. An interior sidewall 202 of similar configuration to exterior sidewall 200 surrounds the interior of stabilizer 560.

A lattice of cells 89, similar to those described above, are formed within stabilizer 560. Preferably cells 89 extend from interior sidewall 200 to exterior sidewall 202. As previously described, cells 89 may be of any geometric configuration, although hexagonal-shaped cells 88, quadrilateral-shaped cells 90 and triangular-shaped cells 92 are shown in the drawings. As best seen in FIG. 9, the exterior and interior sidewalls 200, 202 of stabilizer 560 slope upwardly from a bottom surface 193 to foot supporting surface 190. As a result, the stabilizer is wider at its base than it is at its top to provide additional stability to the foot of a wearer.

In use, each embodiment of the invention functions somewhat similarly. With regard to the embodiment of FIGS. 1–6, beginning with heel strike, the weight of the wearer puts force on the heel supporting areas 48 and 106 of foot support 42 and stabilizer 60, respectively. As the cells 89 of stabilizer 60 compress, the load of the wearer is transferred from the foot to the stabilizer. In the event that the wearer does not land squarely on the heel supporting areas 48 and 106, and rather lands more on the medial or lateral edge of the midsole, stabilizer 60 is designed to compress in a controlled manner to prevent the wearer's foot from rolling over. As the weight of the wearer moves from the heel to the toe, the weight is removed from the heel supporting areas of the midsole and shifted to the forefoot supporting area. With the weight removed, cells 89 are allowed to expand back to their original configuration due to the inherent elasticity of the preferred material used to form the stabilizer.

While the present invention has been particularly shown and described with reference to the preferred embodiments thereof, it will be understood by those skilled in the art that the foregoing and other changes in form axed details may be made therein without departing from the spirit and scope of the invention. An example of one such change would be to remove a portion of the foot support 42 particularly in the heel area 48 and replace the heel area or a portion thereof with another type of cushioning material, for example, a fluid filled bladder (such as is shown in phantom in FIG. 2 at 600). Alternatively, the entire foot support 42 could be replaced by some type of fluid filled bladder or other "mechanical" or non-foam midsole. Another modification which can be made to the present invention would be to reduce the thickness of the walls which form the cells such that the walls surrounding the cells do not extend all the way through the thickness of the stabilizer (as shown in phantom in FIG. 5 at 700).

What we claim is:

1. An article of footwear having a lateral and a medial side comprising:

an upper, said upper consisting of a forefoot portion, a midfoot portion, and a rearfoot portion;

a foot support disposed beneath said upper and formed of a lightweight cushion material for cushioning and supporting a portion of a foot of a wearer, said foot support extending beneath said rearfoot portion of said upper from said lateral to said medial side of said article of footwear, said foot support including a heel area positioned beneath said rearfoot portion of said upper, and an exterior sidewall extending along the periphery of said foot support in said heel area of said foot support;

an outsole disposed beneath said heel area of said foot support;

a recessed sidewall formed within said exterior sidewall of said foot support in said heel area of said foot support along one of said medial and lateral sides of said article of footwear under the area of foot impact upon heel strike, said recessed sidewall forming a recess in said foot support; and a stabilizer disposed within said recess in said foot support and formed of an elastomeric plastic for prevention said foot of said wearer from rolling, said stabilizer including a heel terminus disposed adjacent said rearfoot portion of said upper, a forward terminus disposed adjacent the junction of said midfoot portion of said upper with said rearfoot portion of said upper, a top surface for supporting the force of the weight of the wearer upon impact, a bottom surface spanning the entire length of said stabilizer, and an exterior side surface including a plurality of cells when viewed from the side of said stabilizer, said cells being opened to the atmosphere at said exterior side surface of said stabilizer.

2. The article of claim 1, wherein said plurality of cells are six sided.

3. The article of claim 1, wherein said plurality of cells are formed of at least five obtuse angles.

4. The article of claim 1, wherein said foot support includes a fluid-filled bladder.

5. The article of claim 1, wherein at least one of said plurality of cells extends completely through said stabilizer.

6. The article of claim 1, wherein said stabilizer further comprises a forepart and a rear part, and wherein the width of said exterior side surface of said stabilizer between said plurality of cells is greater in the forepart of said stabilizer than in the rear part thereof.

7. The article of claim 1, wherein said stabilizer extends transversely across approximately one-third of the width of said foot support from one of said medial and lateral sides of said article of footwear to the other.

* * * * *